US009932675B2

(12) United States Patent
Morcos et al.

(10) Patent No.: US 9,932,675 B2
(45) Date of Patent: Apr. 3, 2018

(54) COMPOSITE ELECTROLESS NICKEL PLATING

(71) Applicant: MacDermid Acumen, Inc., Waterbury, CT (US)

(72) Inventors: Boules H. Morcos, Novi, MI (US); Nicole J. Micyus, South Lyon, MI (US); John Pawlowski, Macomb, MI (US)

( * ) Notice: Subject to any disclaimer, the term of this patent is extended or adjusted under 35 U.S.C. 154(b) by 338 days.

(21) Appl. No.: 14/327,995

(22) Filed: Jul. 10, 2014

(65) Prior Publication Data

US 2016/0010214 A1 Jan. 14, 2016

(51) Int. Cl.

| | |
|---|---|
| ***C23C 18/16*** | (2006.01) |
| ***C23C 18/34*** | (2006.01) |
| ***C23C 18/36*** | (2006.01) |

(52) U.S. Cl.

CPC ..... *C23C 18/1646* (2013.01); *C23C 18/1662* (2013.01); *C23C 18/1671* (2013.01); *C23C 18/34* (2013.01); *C23C 18/36* (2013.01)

(58) Field of Classification Search

CPC ..... C23C 18/1671; C23C 18/36; C23C 18/34
See application file for complete search history.

(56) References Cited

U.S. PATENT DOCUMENTS

| | | | | |
|---|---|---|---|---|
| 3,310,707 | A | 3/1967 | Boksjo | |
| 4,503,313 | A | 3/1985 | Tsutsumi | |
| 5,605,565 | A * | 2/1997 | Feldstein | C23C 18/31 106/1.22 |
| 8,598,260 | B2 | 12/2013 | Feldstein et al. | |
| 2003/0165068 | A1* | 9/2003 | Tomonaga | H02M 5/458 363/37 |
| 2004/0221765 | A1 | 11/2004 | Crotty et al. | |
| 2009/0045069 | A1* | 2/2009 | Onodera | C25D 5/08 205/148 |
| 2012/0214924 | A1 | 8/2012 | Feldstein | |
| 2013/0177777 | A1 | 7/2013 | Cao | |
| 2013/0202910 | A1 | 8/2013 | Koppe | |
| 2013/0216720 | A1 | 8/2013 | Pearson et al. | |

FOREIGN PATENT DOCUMENTS

| | | |
|---|---|---|
| EP | 2 182 089 | 5/2010 |
| GB | 1 222 969 | 2/1971 |
| GB | 2 233 982 | 10/1993 |
| WO | 2009/076430 | 6/1999 |

* cited by examiner

*Primary Examiner* — Xiao S Zhao
(74) *Attorney, Agent, or Firm* — Carmody Torrance Sandak & Hennessey LLP

(57) ABSTRACT

A method of producing a composite electroless nickel layer on a substrate is described. The method includes the steps of contacting the substrate with a composite electroless nickel plating bath and generating an electrostatic field in the electroless nickel plating bath. The electric field is generated by placing an anode in the electroless nickel plating bath and connecting the anode to a positive terminal of a DC rectifier, and connecting the substrate to a negative terminal of the DC rectifier, and preferably inserting a capacitor into the circuit to prevent passage of current. An attractive force generated by the electrostatic field increases the attraction of the positively charged PTFE particles to the negatively charged substrate and drives the positively charged PTFE particles to the negatively charged substrate.

14 Claims, No Drawings

COMPOSITE ELECTROLESS NICKEL PLATING

FIELD OF THE INVENTION

The present invention relates generally to a composite electroless nickel plating solution and a method of using the same.

BACKGROUND OF THE INVENTION

Electroless plating refers to the autocatalytic or chemical reduction of aqueous metal ions plated on a base substrate. In electroless plating, use is made of a chemical reducing agent, thus avoiding the need to employ an electrical current as is required in electrolytic plating operations.

Deposits made by electroless plating have unique metallurgical characteristics. For example, the coatings may exhibit good uniformity, excellent corrosion resistance, wear and abrasion resistance, nonmagnetic and magnetic properties, solderability, high hardness, excellent adhesion, and low coefficient of friction. The deposits can be made on a wide range of substrates, including metallic surfaces such as steel, brass, aluminum, aluminum alloy, copper, titanium, titanium alloy, iron, magnesium, magnesium alloy, nickel, nickel alloy, bronze, or stainless steel, among others, and non-metallic surfaces such as plastics, including polyacrylates, polyimides, nylon, polyamides, polyethylene, and polypropylene, among others. In addition, because electroless plating deposits are autocatalytic, it is possible to uniformly plate substrates having complex shapes.

Electroless plating bath compositions typically comprise an aqueous solution containing metal ions to be deposited, catalysts, one or more reducing agents, one or more complexing agents, bath stabilizers and other plating additives, all of which are tailored to a specific metal ion concentration, temperature and pH range.

One of the most common electroless plating systems involves the electroless deposition of a nickel or nickel alloy onto a substrate. Plating baths of this type typically comprise a source of nickel ions and a reducing agent. The plating baths may also include one or more complexing agents, buffers, brighteners when desirable, and various stabilizers to regulate the speed of metal deposition and avoid decomposition of the solution.

In composite electroless plating, insoluble or sparingly soluble particulate matter is intentionally introduced into the electroless plating bath composition for subsequent co-deposition onto a substrate. The uniform dispersion of such micron or sub-micron particles in the electroless metal deposit can enhance the wear, abrasion resistance and/or lubricity of the deposit over base substrates and conventional electroless deposits. Composites containing fluoropolymers, natural and synthetic diamonds, ceramics, chromium carbide, silicon carbide, and aluminum oxide, among others, have been successfully co-deposited.

Coating products using composite plating, especially metalized plating and, more particularly, electroless nickel with fluoropolymer particles such as polytetrafluoroethylene (PTFE), have come into widespread commercialized use around the world in many industries such as high speed components, automotive applications, molds, electronic connectors, textile manufacturing components, material handling devices, machining and tooling parts, cookware and other food handling equipment, among others.

Composite plating with PTFE is accomplished by adding appropriate amounts of a dispersion containing PTFE particles into the plating bath generally containing a metal such as electroless nickel. The PTFE dispersion is formulated to break up any agglomerates and encapsulate the PTFE particles with certain chemicals that allow the PTFE to be dispersed and function properly in the plating bath. Other composite particles may be dispersed into the plating bath in a similar fashion.

The nickel-phosphorus portion of the coating is produced by a chemical reaction that commences at the surface of the substrate. The plating reaction is initiated by the catalytic nature of the substrate and continues due to the catalytic nature of the deposit itself. The rate of nickel phosphorus deposition increases with:

1) Increase in the bath temperature;
2) Increase in the bath pH; and
3) Increase in the concentration of sodium hypophosphite.

Plating systems capable of producing composite coatings of electroless nickel and particles such as PTFE have been around for many years. Typically, the amount of PTFE in the deposit ranges between about 2 and about 8 percent by weight. However, it would be desirable to increase the amount of fluoropolymers such as PTFE in the plating deposit for certain applications.

U.S. Pat. Pub. No. 2013/0202910 to Koppe, the subject matter of which is herein incorporated by reference in its entirety, describes a method of depositing a nickel-metal layer for coloring surfaces in which a nickel bath is used for electroless deposition of a nickel layer and additionally contains a compound for other metal and in which the nickel-metal layer is deposited by simultaneous deposition of nickel from the nickel bath and deposition of the other metal compound from the bath.

WO 2009/076430 to Abys et al., the subject matter of which is herein incorporated by reference in its entirety, describes the electrolytic deposition of metal-based composite coatings comprising nano-particles to impart corrosion resistance onto a surface of a substrate. The composite coating comprises the deposition metal and between about 1 wt. % and about 5 wt. % of the nano-particles. However, the method of Abys is an electrolytic method and not an electroless autocatalytic method and thus is not suitable for plating substrates having complex shapes and configurations.

There remains a need in the art for an improved method of depositing a composite coating of electroless metal and particles that allows for a high weight percentage of particles such as PTFE to be co-deposited with the electroless metal.

SUMMARY OF THE INVENTION

It is an object of the present invention to provide a method of composite electroless plating.

It is another object of the present invention to provide a method of composite electroless plating in which a higher weight percent of particulate matter can be included in the plating deposit.

During composite plating of nickel and fluoropolymer particles such as PTFE, three actions generally take place simultaneously at the surface of the substrate being plated:

1) Nickel-phosphorus deposition;
2) PTFE particle co-deposition; and
3) Hydrogen evolution.

In order to obtain the desired composite coating, the first two actions must be balanced. In addition, the hydrogen must be promptly driven away.

During plating, the co-deposition of PTFE occurs as a result of the electrostatic attraction between the positively-charged particles and the negatively-charged metallic substrate. The rate of PTFE co-deposition increases with:

1) Decrease in the bath temperature;
2) Decrease in the bath pH; and
3) Increase in the PTFE particle concentration.

Thus, it is easy to see that the factors that increase the nickel-phosphorus deposition (i.e., increases in bath temperature and pH) act to decrease the co-deposition of PTFE. Conversely, the factors that increase the rate of PTFE co-deposition tend to reduce the rate of nickel phosphorus deposition. A balanced control of the operating factors is necessary to produce a coating with the desired nickel-phosphors deposition and PTFE (or other particulate matter) co-deposition.

To that end in one embodiment, the present invention relates generally to a method of producing a composite electroless nickel layer on a substrate, the method comprising the steps of:

a) contacting the substrate with an electroless nickel plating bath, the electroless nickel plating bath comprising:
   i) a source of nickel ions;
   ii) a reducing agent; and
   iii) a PTFE dispersion, the PTFE dispersion comprising:
      1) PTFE particles;
      2) a blend of non-ionic and cationic surfactants; and
      3) water
b) generating an electrostatic field in the electroless nickel plating bath by (i) placing an anode in the electroless nickel plating bath and connecting the anode to a positive terminal of a DC rectifier; and (ii) connecting the substrate to a negative terminal of the DC rectifier, whereby the substrate is negatively charged;

wherein an attractive force generated by the electrostatic field increases the attraction of the positively charged PTFE particles to the negatively charged substrate and drives the positively charged PTFE particles to the negatively charged substrate. Preferably the CD rectifier has a capacitor in the circuit between the anode and the cathode.

DETAILED DESCRIPTION OF THE PREFERRED EMBODIMENTS

The inventors of the present invention have developed a method of producing a composite electroless nickel coating on a substrate that increases the amount of co-deposited particles, including fluoropolymers such as PTFE.

In one embodiment, the present invention relates generally to a method of producing a composite electroless nickel layer on a substrate, the method comprising the steps of:

a) contacting the substrate with an electroless nickel plating bath, the electroless nickel plating bath comprising:
   i) a source of nickel ions;
   ii) a reducing agent; and
   iii) a PTFE dispersion, the PTFE dispersion comprising:
      1) PTFE particles;
      2) a blend of non-ionic and cationic surfactants; and
      3) water
b) generating an electrostatic field in the electroless nickel plating bath by (i) placing an anode in the electroless nickel plating bath and connecting the anode to a positive terminal of a DC rectifier; and (ii) connecting the substrate to a negative terminal of the DC rectifier, whereby the substrate is negatively charged.

wherein an attractive force generated by the electrostatic field increases the attraction of the positively charged PTFE particles to the negatively charged substrate and drives the positively charged PTFE particles to the negatively charged substrate. Preferably the CD rectifier has a capacitor in the circuit between the anode and the cathode to present the flow of current.

As described herein, an electrical field is set up by adding an electrode (anode) to the plating tank and connecting it to the positive terminal of a DC rectifier. The metallic substrate, is connected to the negative terminal of the rectifier. A capacitor is preferably inserted into the circuit between the anode and the cathode to prevent the passage of current. The rectifier voltage is set high enough to generate a potential difference between the two electrodes. The rectifier and the inert anode create a mild electrostatic potential of between about 0.5 and about 2 volts, more preferably between about 0.8 and 1.5 volts and most preferably at about 1 volt). Based thereon, the attractive force generated by the electrostatic field drives the positively-charged PTFE particles to the negatively-charged substrate.

The generated electrostatic field increases the attraction of the positively-charged PTFE particles to the negatively-charged substrate. The result is a substantial increase in the amount of PTFE occluded in the deposit. Using the method described herein, it is possible to produce composite electroless nickel deposits containing between about 12 to about 16 percent by weight PTFE, which is a 50-100% increase over the best the current technology can achieve.

As described herein, the substrate is a metallic substrate or is preferably plated with a strike layer or other metallic layer for subsequent electroless nickel plating thereon. For example, the substrate may be selected from the group consisting of steel, brass, aluminum, aluminum alloy, copper, titanium, titanium alloy, iron, magnesium, magnesium alloy, nickel, nickel alloy, bronze, or stainless steel and combinations of one or more of the foregoing.

Depending on the substrate used, the surface of the substrate can be pretreated, for example by degreasing, pickling, e.g. with a solvent, lye, acid etching, nickel strike or similar methods known to a person skilled in the art.

The nickel ions of the bath are preferably in the form of solutions of the salts nickel chloride, nickel sulfate, nickel carbonate and/or nickel acetate. The nickel content is usually in a range from 3 to 10 g/l.

A phosphorus or boron compound is preferably used as reducing agent in the bath. Thus, the reducing agent may be sodium hypophosphite, potassium hypophosphite, sodium borohydride, n-dimethyl amine borane (DMAB), n-diethylamine borane, formaldehyde, hydrazine or other similar compound. The reducing agent is usually present in the bath at a concentration in a range of about 5 to about 50 g/L, more preferably in a range of about 30 to about 40 g/L.

The bath also includes at least one complexing agent, which is selected in particular from the group monocarboxylic acids, dicarboxylic acids, hydroxycarboxylic acids, ammonia and alkanolamines. The complexing agent is generally present in the bath at a concentration in a range of about 10 to about 100 g/L, more preferably in a range of about 30 to about 40 g/L. Complexing agents complex nickel ions and thus prevent excessively high concentrations of free nickel ions. As a result the solution is stabilized and the precipitation of for example nickel phosphite is suppressed. Complexing agents act as a buffer to help control pH and maintain control over the free metal salt ions available to the solution, thus providing solution stability.

The bath may also include at least one accelerator, such as fluorides, borides or anions of mono- and dicarboxylic acids. If used, the accelerator is present in the bath at a concentration in a range from 0.001 to 1 g/L. Accelerators can activate hypophosphite ions and thus accelerate deposition.

The nickel bath may also contain at least one stabilizer, which may be lead, tin, arsenic, molybdenum, cadmium, thallium ions and/or thiourea. Stabilizers are used to prevent decomposition of the solution, by masking catalytically active reaction nuclei. If used, the stabilizer is used in the bath at a concentration in a range from 0.01 to 250 mg/L.

The bath also typically contain at least one pH buffer, which may be a sodium salt of a complexing agent and/or also the associated corresponding acid to keep the pH constant for longer operating times. The buffer is present in the bath at a concentration in a range from 0.5 to 30 g/L.

The bath may also contain at least one pH-regulator, which in particular is selected from the group sulfuric acid, hydrochloric acid, sodium hydroxide, sodium carbonate and/or ammonia. The pH-regulator is usually present in the bath at a concentration in a range from 1 to 30 g/l. pH-regulators allow subsequent adjustment of the pH of the bath. The pH of the bath is preferably maintained within a range of about 4.5 to about 5.5, more preferably about 4.8 to about 5.2.

In addition, a typical composite electroless nickel plating bath is maintained at a temperature of between about 170 F and about 180° F. while the substrate is being contacted with the composite electroless nickel plating bath. The inventors of the present invention have found that decreasing the temperature of the bath produces good results and aids in increasing the amount of PTFE dispersion contained in the deposited plating layer. Thus, the inventors have found that it is desirable to run the bath at a temperature that is at least about 10° F. cooler than the standard composite plating bath, more preferably at least about 15° F. cooler than the standard composite plating bath. Thus, the plating bath described herein is preferably maintained at a temperature of between about 170 F and about 185 F, more preferably at a temperature of between about 175 F and about 180 F.

Using the bath described herein, it is possible to produce electroless nickel deposits having about 12 to about 16 percent by weight of PTFE, which is about twice the maximum amount obtained by standard plating methods.

The PTFE dispersion disposed in the electroless nickel plating bath typically comprises finely divided PTFE particles, water and a blend of nonionic and cationic surfactants. The concentration of PTFE in the dispersion is typically in the range of about 400 to about 800 g/L, more preferably at about 500 to about 600 g/L. The nominal particle size is about 0.4 micron.

Surfactants are added to the plating composition to promote wetting of the substrate surface and modify the surface tension of the electroless nickel plating solution to between about 25 and about 40 dyne-cm. A low surface tension is advantageous to enhance wetting of the substrate surface, enhance the ability of the solution to get rid of gas bubbles, and prevent pits/voids on the surface. A low surface tension also increases the solubility of organic materials such as grain refiners, brighteners and other bath additives.

Nonionic surfactants are used to reverse the hydrophobic nature of the PTFE. Suitable non-ionic surfactants include, but are not limited to, aliphatic alcohols such as alcohol alkoxylates, especially those having carbon chains of 7 to 15 carbons, linear or branched, and 4 to 20 moles of ethoxylate, ethylene oxide-propylene oxide block copolymer (EO/PO), alkoxylated fatty acid esters, and polyethylene glycol and polypropylene glycol of glycol ether and glyceryl ethers. Examples of preferred compounds include polyethylene glycol tert-octylphenyl ether and polyoxyethylene sorbitol monolaurate. Non-ionic surfactants are available under the tradenames Triton (such as Tritox X-100, which is a polyethylene glycol tert-octylphenyl ether), Tergitol non-ionic EO/PO surfactants, available from Dow Chemical Co., Inc., NEODOL 91-6 and NEODOL 91-8 (available from Shell Chemical Co., Inc.), among others. Other surfactants include non-ionic, ethoxylated nonionic fluorine-containing surface active agents.

Cationic surfactants are used to impart a positive charge on the particles to generate an electrostatic force between them and the negatively charged substrate. The cationic surfactant may have an organic anion. For example, quaternary ammonium, quaternary phosphonium and quaternary sulfonium compounds having an alkyl chain with 6 to 32 carbon atoms, can be used. The organic anion may be a carboxylate, phosphonate or sulfonate anion. Thus, in one embodiment, the cationic surfactant may be selected from the group consisting of alkyl amines, alkyl diamines, and alkyl imidazoles. The cationic surfactant may also be selected from the group consisting of quaternary amine compounds, including quaternary imidazoles, quaternary alkyl amines such as cetyl trimethylammonium compounds and quaternary aromatic alkyl amines. Other suitable corrosion inhibitors include centrimonium bromide (CAS#57-09-0) and stearalkonium chloride (CAS#122-19-0). Quaternary cationic fluorosurfactants are also effective for use in compositions of the present invention.

There are applications such as reaction injection molding (RIM) of polyurethanes where the hydrophobicity of the composite coating must be increased to eliminate the tendency of the molded parts from sticking to the mold itself.

During plating a thin layer of PTFE particles adheres to the surface being plated. The hydrogen gas that evolves as a by-product of the plating reaction clings to the substrate. To avoid pitting problems, provisions for mild mechanical agitation are incorporated to promptly drive the hydrogen away during plating and to prevent the PFTE from settling out during idle times.

The particles can be selected such that the properties of the deposit are also improved in a desired manner. Suitable particles include, but are not limited to, fluorocarbons such as PTFE and perfluoroalkoxy alkane (PFA), colloidal silica, colloidal graphite, carbon nanotubes, boron nitride, ceramics, silicon carbide, nano-diamond, diamond and the like as well as combinations of one or more of the foregoing. In a preferred embodiment, the particles comprise PTFE. The particles have an average particle size of between about 0.2 μm and about 10 μm.

In one embodiment, the particles are treated with the cationic surfactant so that the cationic surfactant is adsorbed on the particles. By treating particles with a cationic surfactant either before their inclusion in the plating bath or in the plating bath itself, when these particles are dispersed in a plating bath, the particle dispersion readily co-deposits with the metal due to the positive charge on the particles. The cationic surfactant adsorbed on the particles then inhibits cathodic reduction reactions on the co-deposited metal such that the galvanic and contact corrosion properties of the metal are improved.

Comparative Example 1

An electroless nickel bath was prepared with the following composition:

6 g/l nickel (as nickel sulfate)
40 g/l sodium hypophosphite
5 g/l PTFE particles
pH—5.0

This bath was used to plate at 180 F and yielded a deposit that contained 9% by weight PTFE.

Example 1

The same bath as in Comparative Example 1 was used to plate under the same process conditions, except that an electrostatic field of 1 volt was applied in accordance with this invention. The deposit which was produced contained 14% by weight PTFE.

Thus, it can be seen that the use of an electrostatic field in the manner described herein allows the composite electroless nickel plating bath to produce a composite electroless nickel layer on a substrate having a much higher weight percentage of particles than the methods of the prior art.

What is claimed is:

1. A method of producing a composite electroless nickel layer on a substrate, the method comprising the steps of:

a) contacting the substrate with an electroless nickel plating bath, the electroless nickel plating bath comprising:
   i) a source of nickel ions;
   ii) a reducing agent; and
   iii) a PTFE dispersion, the PTFE dispersion comprising:
      1) PTFE particles;
      2) a blend of non-ionic and cationic surfactants; and
      3) water;
      wherein the PTFE particles are treated with a cationic surfactant such that the cationic surfactant is adsorbed onto the PTFE particles prior to the inclusion of the PTFE particles in the plating bath, and the PTFE particles are positively charged;

b) generating an electrostatic field in the electroless nickel plating bath by (i) placing an anode in the electroless nickel plating bath and connecting the anode to a positive terminal of a DC rectifier; and (ii) connecting the substrate to a negative terminal of the DC rectifier;

wherein an attractive force generated by the electrostatic field increases the attraction of the positively charged PTFE particles to the negatively charged substrate and drives the positively charged PTFE particles to the negatively charged substrate; and wherein a capacitor is placed in the circuit between the anode and the cathode.

2. The method according to claim 1, wherein the generated electrostatic field has a magnitude of between about 0.5 and about 2.0 volts.

3. The method according to claim 2, wherein the generated electrostatic field has a magnitude of about 0.8 to about 1.5 volts.

4. The method according to claim 1, wherein the reducing agent is selected from the group consisting of sodium hypophosphite, potassium hypophosphite, sodium borohydride, n-dimethylamine borane, n-diethylamine borane, formaldehyde, hydrazine and combinations of one or more of the foregoing.

5. The method according to claim 4, wherein the reducing agent comprises sodium hypophosphite or potassium hypophosphite.

6. The method according to claim 1, wherein the electroless nickel plating bath comprises at least one complexing agent.

7. The method according to claim 1, wherein the at least one complexing agent is selected from the group consisting of monocarboxylic acids, dicarboxylic acids, hydroxycarboxylic acids, ammonia and alkanolamines.

8. The method according to claim 1, wherein the electroless nickel plating bath comprises at least one of an accelerator, a stabilizer, a pH buffer, and a pH regulator.

9. The method according to claim 1, wherein the composite nickel plating layer comprises between about 12 and about 16 percent by weight of PTFE.

10. The method according to claim 1, wherein the composite nickel plating layer comprises at least about 10 percent by weight of PTFE.

11. The method according to claim 1, wherein the substrate is selected from the group consisting of steel, brass, aluminum, aluminum alloy, copper, titanium, titanium alloy, iron, magnesium, magnesium alloy, nickel, nickel ally, bronze, stainless steel, and combinations of one or more of the foregoing.

12. The method according to claim 1, wherein at least a surface of the substrate to be plated is pretreated.

13. The method according to claim 1, wherein the electroless nickel plating bath is maintained at a temperature of between about 170° F. and about 180° F.

14. The method according to claim 1, wherein the PTFE particles are treated with the cationic surfactant so that the cationic surfactant is adsorbed onto the PTFE particles.

* * * * *